US006845698B2

(12) United States Patent
McAbee et al.

(10) Patent No.: US 6,845,698 B2
(45) Date of Patent: Jan. 25, 2005

(54) SYSTEMS AND METHODS FOR SEVERING ELONGATED MATERIAL

(75) Inventors: Timothy S. McAbee, Forest City, NC (US); Songhao Wang, Pittsburgh, PA (US); William L. Schaefer, Butler, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 10/082,513

(22) Filed: Feb. 25, 2002

(65) Prior Publication Data

US 2003/0162452 A1 Aug. 28, 2003

(51) Int. Cl.[7] ..... B26D 5/00

(52) U.S. Cl. ..... 83/74; 83/344; 83/368; 83/913

(58) Field of Search ..... 83/74, 75, 76, 83/76.6, 76.9, 299, 311, 343, 344, 346, 347, 368, 508.1, 508.2, 913, 950

(56) References Cited

U.S. PATENT DOCUMENTS

| | | | | | |
|---|---|---|---|---|---|
| 3,997,306 | A | | 12/1976 | Hedden | 65/3 C |
| 4,255,998 | A | * | 3/1981 | Rudszinat | 83/299 |
| 4,305,742 | A | | 12/1981 | Barch et al. | 65/3.43 |
| 4,512,225 | A | * | 4/1985 | Green | 83/76 |
| 4,542,106 | A | | 9/1985 | Sproull | 501/38 |
| 4,771,665 | A | * | 9/1988 | Van Doorn et al. | 83/347 |
| 4,927,869 | A | | 5/1990 | Dana et al. | 523/502 |
| 5,201,272 | A | * | 4/1993 | Simon | 101/485 |
| 5,398,575 | A | | 3/1995 | Rewitzer | |
| 5,412,301 | A | | 5/1995 | Jornot et al. | |
| 5,668,744 | A | | 9/1997 | Varadan et al. | |
| 5,720,210 | A | * | 2/1998 | Okahashi | 83/344 |
| 5,779,793 | A | | 7/1998 | Sand | |
| 5,789,329 | A | | 8/1998 | Eastes et al. | 501/36 |
| 5,883,023 | A | | 3/1999 | Martine et al. | 442/331 |
| 5,908,689 | A | | 6/1999 | Dana et al. | 428/219 |
| 5,970,837 | A | * | 10/1999 | Arterburn et al. | 83/913 |
| 6,148,641 | A | | 11/2000 | Blough et al. | |
| 6,158,316 | A | * | 12/2000 | Ichikawa et al. | 83/74 |
| 6,360,640 | B1 | * | 3/2002 | Cote | 83/311 |
| 6,564,684 | B2 | | 5/2003 | Bascom et al. | |
| 6,619,573 | B2 | | 9/2003 | Arterburn et al. | |

FOREIGN PATENT DOCUMENTS

| | | |
|---|---|---|
| EP | 1 072 700 A1 | 1/2001 |
| WO | WO 01/20065 A1 | 3/2001 |

OTHER PUBLICATIONS

K. Lowenstein, *The Manufacturing Technology of Glass Fibers*, (3d Ed. 1993) at pp. 25, 30–44, 47–60, 85–107, 115–235, 237–291.

*Encyclopedia of Polymer Science and Technology*, vol. 6 (1967) at pp. 505–712.

International Search Report mailed Jun. 16, 2003 corresponding to PCT/US 03/05900.

* cited by examiner

*Primary Examiner*—Stephen Choi
(74) *Attorney, Agent, or Firm*—Dennis G. Millman

(57) ABSTRACT

Systems and methods for severing elongated material include a rotatable first roll having a first severing structure, a rotatable second roll having a second severing structure corresponding with the first severing structure for severing a length of the filament positioned between the rolls, a drive system operable to independently rotate the first roll and the second roll according to a drive command, a sensor system operable to make measurements and generate actual position signals representative of an actual current rotational position of the first roll and an actual current rotational position of the second roll, and a control system for receiving the position signals and operable to generate the drive command in accordance with predetermined control parameters and based on the actual rotational position signals, wherein the drive command synchronizes the respective rotational positioning of the first roll and the second roll.

16 Claims, 7 Drawing Sheets

SYSTEMS AND METHODS FOR SEVERING ELONGATED MATERIAL

This invention relates generally to chopping elongated material, and more particularly, to systems and methods for severing elongated filaments and strands into short lengths.

In the manufacture of composite materials, fiber choppers are utilized to break continuous lengths of filaments into individual short filament lengths for use in the making of fiber mats, shells, structural elements, reinforcing materials and the like. The short filament lengths are formed by passing the filament between an opposed pair of rollers. One of these rollers, known as the cutter roll, includes a plurality of longitudinally extending cutting blades spaced apart on the outer periphery of the roller. The other roller, known as the cot roll, has a resilient cot or tire on its periphery with a plurality of longitudinally extending, spaced apart slots. The cutter roll and cot roll are positioned and rotated so that the filaments are cut or severed by passing between the blades and the slots.

One problem with typical fiber choppers is that the resilient cot, made from a material such as elastomer or polyurethane, quickly wears and thus requires frequent changing of the cot roll. In typical choppers, the blades of the cutter roll are used to initially form the slots in the cot roll. Further, the cot roll is then used to drive the cutter roll. More particularly, the cot roll is attached to a motor that rotates the roll. As the cot roll rotates, the walls of the rotating slots catch the blades thereby rotating the cutting roll. This interaction between the blades and the slots, in combination with the positioning of the filaments between a blade and a slot, cause the side walls and outer edges of the slots to deteriorate. This in turn can deteriorate the quality of the chopped product. To compensate for this deterioration, an operator must radially reposition the cutting roll relative to the cot roll, i.e. move the axis of rotation of each roll closer to each other, such that the repositioned blades more deeply penetrate the slot. This ability to compensate for the wear of the resilient cot is limited, however, by the thickness of the resilient cot and because the deterioration of the side wall soon causes the slots to run into one another. Additionally, misalignment between the blade and the slot, and mechanical errors and losses in the rotational and radial positioning of the rolls, causes additional deterioration of the slots and wear on the blades, thereby increasing costs associated with operating and maintaining a fiber chopper.

Thus, embodiments of the present invention provide systems and methods for synchronizing the cot roll and the cutter roll to reduce or eliminate deterioration and wear in the components of both the cot roll and the cutter roll. The synchronization includes a rotational and/or angular positioning of the respective rolls, as well as a radial positioning of one roll with respect to the other.

The present invention provides an apparatus for producing discontinuous lengths of filament, comprising: a rotatable first roll having a first severing structure; a rotatable second roll having a second severing structure, the second severing structure corresponding with the first severing structure for severing a length of the filament positioned between the rolls; a drive system operable to independently rotate the first roll and the second roll according to a drive command; a sensor system operable to make measurements and generate current state signals representative of at least one actual current roll property of the first roll and at least one actual current roll property of the second roll; and a control system for receiving the current state signals and operable to generate the drive command in accordance with predetermined control parameters and based on the at least one actual current roll property of the first roll and the at least one actual current roll property of the second roll, wherein the drive command synchronizes the at least one actual current roll properties of the first roll and the second roll.

The present invention also provides an apparatus for producing discontinuous lengths of filament, comprising: a rotatable first roll having a first severing structure; a rotatable second roll having a second severing structure, the second severing structure corresponding with the first severing structure for severing a length of filaments positioned between the rolls; a drive system operable to independently rotate the first roll and the second roll according to a first roll drive command and a second roll drive command, respectively; a sensor system operable to receive rotational positional inputs representative of an actual current rotational position of the first roll and an current rotational position of the second roll, the sensor system further operative to generate a first roll current position state signal and a second roll current position state signal corresponding to the rotational positional inputs; a control system operable to receive the first roll current position state signal and the second roll position state signal and generate the first roll drive command and the second roll drive command, respectively, in accordance with a predetermined set of control parameters and as determined by the first roll current position state signal and the second roll current position state signal, wherein the control system determines the first roll drive command and the second roll drive command so that the respective positioning of the corresponding severing structures is synchronized during rotation of the first roll and the second roll.

The present invention further provides an apparatus for producing discontinuous lengths of filament, comprising: a rotatable first roll having a first severing structure; a rotatable second roll having a second severing structure, the second severing structure corresponding with the first severing structure for severing a length of the filament positioned between the rolls; a drive system operable to independently rotate and radially position the first roll and the second roll according to a first roll drive command, a second roll drive command, and a roll spacing drive command; a sensor system operable to receive positional inputs representative of an actual current rotational position of the first roll, an actual current rotational position of the second roll, and an actual current radial spacing between the first roll and the second roll, the sensor system further operative to generate a first roll current rotational position state signal, a second roll current rotational position state signal, and a current radial spacing state signal corresponding to the positional inputs; and a control system operable to receive the first roll current rotational position state signal, the second roll current rotational position state signal, and the current radial spacing state signal and generate the first roll drive command, the second roll drive command, and the spacing drive command, wherein the control system synchronizes the positioning of the first severing structure and second severing structure during rotation of the first roll and the second roll.

Another embodiment of the present invention provides a method for producing discontinuous lengths of filament, comprising: receiving current state signals representative of an actual current roll property of a first roll having a first severing structure and an actual current roll property of a second roll having a second severing structure, wherein the first roll and the second roll are independently rotatable, and the second severing structure corresponds with the first severing structure; and generating a drive command based on predetermined control parameters and the current state signals, wherein the drive command rotationally synchronizes the actual current roll property of the first roll with the actual current roll property of the second roll for severing a length of the filament positioned between the rolls.

The present invention also provides a method for producing discontinuous lengths of filament, comprising: rotating a first roll having a first severing structure; rotating a second roll having a second severing structure; monitoring actual current rotational position of the first roll; generating a first roll current rotational position signal representative of the actual current rotational position of the first roll; monitoring actual current rotational position of the second roll; generating a second roll current rotational position signal representative of the actual current rotational position of the second roll; generating a first roll drive command in accordance with predetermined control parameters and based on the actual current rotational position of the first roll and a desired rotational position of the first roll; and generating a second roll drive command in accordance with predetermined control parameters and based on the actual current rotational position of the second roll and a desired rotational position of the second roll, wherein the first drive command and second drive command synchronizes the first severing structure of the first roll and the second severing structure second roll for severing a length of the filament positioned between the first and second rolls.

The foregoing summary, as well as the following detailed description of embodiments of the present invention, will be better understood when read in conjunction with the appended drawings. In the drawings.

The present invention provides an apparatus and method for chopping elongated materials, such as but not limited to continuous glass fibers. For the purposes of this specification, other than in the operating examples, or where otherwise indicated, all numbers expressing quantities of speeds, distances, and so forth used in the specification and claims are to be understood as being modified in all instances by the term "about." Accordingly, unless indicated to the contrary, the numerical parameters set forth in the following specification and attached claims are approximations that may vary depending upon the desired properties or performance sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Figure 1:
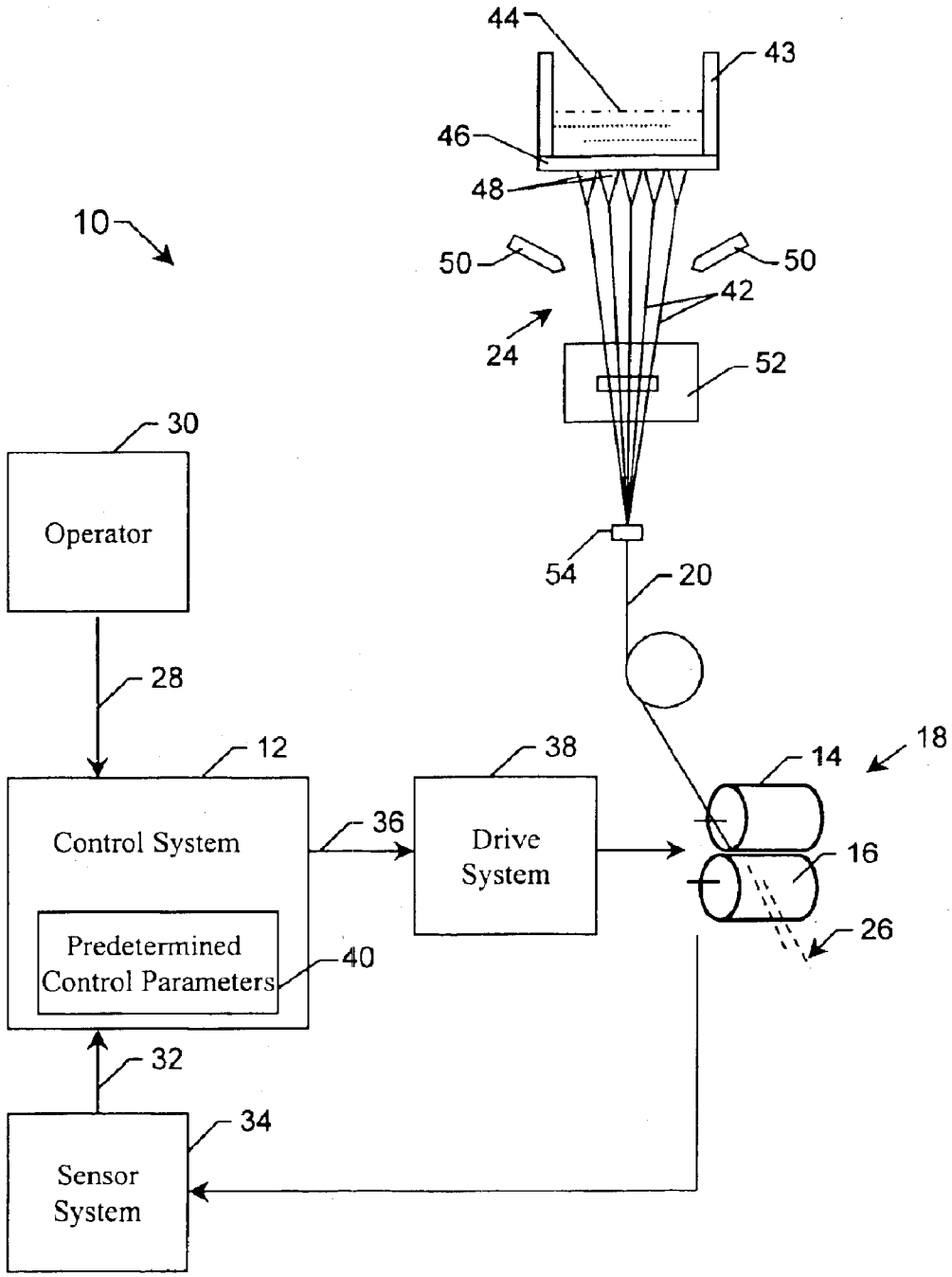
FIG. 1 is a schematic block diagram of a system for severing elongated material incorporating features of the present invention.

Referring to FIG. 1, in one nonlimiting embodiment of the present invention, a system 10 for severing elongated material, e.g. continuous lengths of strands of filament to produce discontinuous lengths of strands, includes a control system 12 for rotationally and/or positionally synchronizing a first roll 14 and a second roll 16 of a fiber chopper 18. First roll 14 includes a first severing structure and second roll 16 includes a second severing structure that cooperates with the first severing structure for severing at least one strand 20 positioned between the rolls. As used herein the term "strand" means a plurality of continuous filaments or fibers. Strand 20 is supplied to chopper 18 in any convenient manner known to those skilled in the art, e.g. directly from the fiber forming operation or from a previously formed supply of fibers and strands, as will discussed later in more detail. To cut strand 20 into individual chopped strands 26, control system 12 receives system commands 28 from an operator 30 and feedback commands 32 from a sensor system 34 and determines drive commands 36 to operate a drive system 38 that independently rotates and positions rolls 14 and 16 of fiber chopper 18. Control system 12 determines drive commands 36 according to predetermined control parameters 40 that rotationally and radially adjust first roll 14 and second roll 16 with respect to each other for synchronized cutting. Additionally, predetermined control parameters 40 adjust for any error between a desired rotational position and/or radial spacing of each roll associated with system commands 28, and an actual rotational position and/or radial position, or spacing 41 (shown in FIG. 2), of each roll associated with feedback commands 32. By controlling the rotational position of first roll 14 and second roll 16, and by controlling the spacing 41 between the rolls, system 10 is able to synchronize the rolls with respect to each other in order to reduce and/or eliminate wear in the severing components of both rolls. Thus, system 10 provides fiber chopper 18 with independently rotatable rolls having synchronized, cooperating severing mechanisms and a feedback mechanism for insuring the synchronization of the rolls.

As discussed above, system 10 can include any system for supplying elongated filaments or strands that are cut into shorter individual particles or chopped strands. Although not limiting in the present invention, in the particular embodiment illustrated in FIGS. 1 and 2, strand 20 is supplied directly from a glass fiber forming operation 24. Fibers 42 are supplied from a glass melting furnace or forehearth 43 containing a supply of a fiber forming molten glass 44 and having a metal bushing 46 attached to the bottom of the forehearth. The molten glass 44 is drawn through a plurality of nozzles 48 in the bushing 46. The pulling of the glass as it passes between rolls 14 and 16 of the fiber chopper 18 attenuates the glass and forms glass fibers 42. Sprayers 50 can be used to spray water or another liquid at the newly formed fibers 42 to cool them after being drawn from the bushing 46. For clarity in the drawing, the ceramic materials, cooling tubes and fins surrounding the metal bushing have been omitted. Alternatively, the forming apparatus 24 can be, for example, a forming device for synthetic textile fibers or strands in which fibers are drawn from nozzles, such as but not limited to a spinneret, as is known to those skilled in the art. Typical forehearths and glass fiber forming arrangements are shown in K. L. Loewenstein, *The Manufacturing Technology of Glass Fibres*, (Third Edition 1993) at pages 85–107 and pages 115 to 235, which is hereby incorporated by reference. This type of chopping arrangement is sometimes referred to as direct chop or direct wet chop.

As an alternative, the glass drawn from the nozzles can be attenuated by winding the strands onto a forming package of a winder as is well know in the art. The forming packages can then be removed from the glass forming operations and the wet glass strands can be transferred to a chopping operation (sometime referred to as remote wet chop) or the forming packages can first be dried before the strands are chopped (sometimes referred to as dry chop or remote dry chop).

The glass fibers can be formed from any type of fiberizable glass composition known to those skilled in the art including those prepared from fiberizable glass compositions such as "E-glass", "A-glass", "C-glass", "D-glass", "R-glass", "S-glass" and E-glass derivatives. As used herein "E-glass derivatives" means glass compositions that include minor amounts of fluoride and/or boron, and preferably are fluorine-free and/or boron-free. Furthermore, as used herein, "minor amounts of fluorine" means less than 0.5 weight percent fluorine, such as, for example, less than 0.1 weight percent fluorine, and "minor amounts of boron" means less than 5 weight percent boron, such as, for example, less than 2 weight percent boron. Basalt and mineral wool are examples of other fiberizable glass materials useful in the present invention. In one embodiment, the glass fibers can be formed from E-glass or E-glass derivatives. Such compositions are well known to those skilled in the art. If additional information is needed, such glass compositions as well as fiberization methods are disclosed in *Loewenstein* at pages 30–44, 47–60, 115–122 and 126–135 and U.S. Pat. No. 4,542,106 (see column 2, line 67 through column 4, line 53) and U.S. Pat. No. 5,789,329 (column 2, line 65 through column 4, line 24), which are hereby incorporated by reference.

The glass fibers can have a nominal filament diameter ranging from 5.0 to 35.0 micrometers (corresponding to a filament designation of D through U and above). For further information regarding nominal filament diameters and designations of glass fibers, see *Loewenstein* at page 25, which is hereby incorporated by reference.

The present invention can also use fibers or strands of materials other than glass fibers ("non-glass fibers"). Suitable non-glass fibers which can be formed using in the present invention are discussed at length in the *Encyclopedia of Polymer Science and Technology*, Vol. 6 (1967) at pages 505–712, and U.S. Pat. No. 5,883,023 (column 8, line 55 through column 9, line 67), which are hereby incorporated by reference.

Typically, after the glass fibers 42 are drawn from the bushing 46, they are contacted with an applicator 52 to apply a coating or sizing composition to the surfaces of the glass fibers to protect the fiber surface from abrasion during processing. As, used herein, the terms "size", "sized" or "sizing" refer to the composition commonly applied to the fibers 42 immediately after formation. Typical sizing compositions can include as components, among other constituents, film-formers, lubricants, coupling agents, emulsifiers and water. Non-limiting examples of sizing compositions that can be used in the present invention are disclosed in assignee's U.S. Pat. No. 3,997,306 (see column 4, line 60 through column 7, line 57); U.S. Pat. No. 4,305,742 (see column 5, line 64 through column 8, line 65) and U.S. Pat. No. 4,927,869 (see column 9, line 20 through column 11, line 19), and U.S. Pat. No. 5,908,689 (see column 5, line 48 through column 7, line 34), which are hereby incorporated by reference. Additional information and further non-limiting examples of suitable sizing compositions are set forth in *Loewenstein* at page 237–291, which is hereby incorporated by reference.

A gathering device 54 mounted in any convenient manner below the applicator 52 is used to gather selected groups of fibers 42 to form one or more strands 20. The strands 20 typically have about 100 to about 15,000 fibers per strand, for example 200 to 7,000 fibers, and are drawn through the gathering device 32 at speeds of 2,500 to 18,000 feet per minute (762 to 5486 meters per minute). Although not limiting in the instant invention, the particular gathering device 54 shown in FIG. 1 forms four strands 20, but it should be appreciated that fibers 42 can be divided into fewer or more strands, for example 1 to 20 strands, or 1 to 16 strands. Strands 20 can also be formed from fibers drawn from a plurality of adjacent bushings.

In the particular nonlimiting embodiment of the invention shown in FIG. 1, after being gathered, strands 20 are directed by one or more rollers 56 into fiber chopper 18, where the continuous strand is severed to produce the plurality of individual chopped strands or fibers 26. The individual chopped strands or fibers 26 can be collected and packaged for later use or directed to further processing steps in order to fabricate products such as fiber mats, shells, structural elements, reinforcing materials and the like (not shown).

Control system 12 can include a computer, a programmable logic controller, a motion controller or other similar device capable of receiving operational inputs and processing them to generate operational outputs. In particular, one nonlimiting example of a suitable control system 12 includes a model number MP940 machine controller from Yaskawa Electric America (Waukegan, Ill.). Control system 12 can include one or more components such as a processor, a memory, input/output devices, and data pathways (e.g., buses) connecting the processor, memory and input/output devices. The processor accepts instructions and data from the memory and performs various calculations. The processor can include an arithmetic logic unit (ALU) that performs arithmetic and logical operations and a control unit that extracts instructions from memory and decodes and executes them, calling on the ALU when necessary. The memory can include a random-access memory (RAM) and a read-only memory (ROM), however, there can be other types of memory such as programmable read-only memory (PROM), erasable programmable read-only memory (EPROM) and electrically erasable programmable read-only memory (EEPROM). In addition, the memory can contain an operating system, which executes on the processor. The operating system performs basic tasks that include recognizing input, sending output to output devices, keeping track of files and directories and controlling various peripheral devices.

Figure 2:
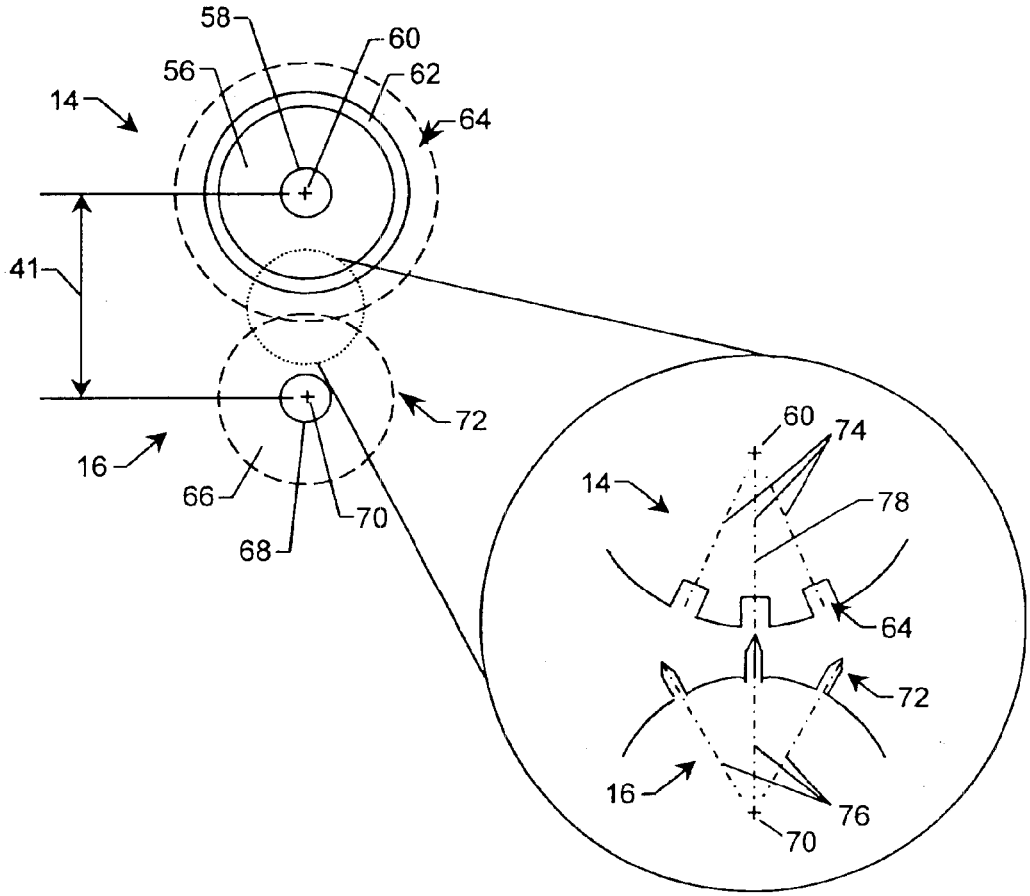
FIG. 2 is a schematic side view, including an enlarged side view, first and second rolls of a fiber chopper incorporating features of the present invention, where the first and second roll have respective first and second severing structure at predetermined relative positions, with portions removed for clarity.

Referring to the embodiment of the invention shown in FIG. 2, first roll 14 is a cot roll and second roll 16 is a cutter roll. First roll or cot roll 14 can include an elongated cylinder, roll or bar 56 mounted to a shaft 58 longitudinally centered on an axis of rotation 60 of the cot roll. Supported by bar 56 is an annular cot or tire 62 with a plurality of slots 64 spaced apart about the outer periphery or circumference of the cot roll 14, defining the first severing structure. In one nonlimiting embodiment, cot 62 may be formed from a material such as an elastomer, a natural rubber, a synthetic rubber, polyurethane and the like. In another nonlimiting embodiment, cot roll 14 includes a substantially homogeneous, relatively hard material having integrally-formed slots 64. For example, cot roll 14 can be a gear-like structure formed from a metal. Second roll or cutter roll 16 includes an elongated cylinder, roll or bar 66 mounted to a shaft 68 longitudinally centered on an axis of rotation 70 of the cutter roll. Cutter roll 16 includes a plurality of elongated structures 72, such as cutting blades or gear-like teeth, spaced apart about the outer periphery or circumference of the cutter roll, thereby defining the second severing structure. In the case of cutting blades, the blades can have any configuration required to form the chopped strands, e.g. a single or double bevel blade. The plurality of slots 64 correspond to the plurality of elongated structures 72 such that, with a predetermined spacing 41 and upon rotation of the rolls 14 and 16, the slots and elongated structures cooperate to sever any strands 20 (FIG. 1) positioned between the rolls. The plurality of slots 64 and the plurality of elongated structures 72 can be correspondingly positioned to extend across the respective rolls 14 and 16 in a longitudinal direction, parallel to the rotational axes 60 and 70, or at some other angle with respect to the longitudinal direction that promotes severing of strands 20. For example and without limiting the present invention, slots 64 and corresponding elongated structures 72 can extend along rolls 14 and 16, respectively in a coordinating helical pattern. The desired chopped strand length will determine the actual spacing of the slots 64 in roll 14 and structures 72 in roll 16.

Rolls 14 and 16 can be of any diameter and the respective slots 64 and elongated structures 72 can be of any spacing, width, length or depth as long as an appropriate diameter or gear ratio is achieved to continually position a given elongated structure within a given slot as the rolls rotate. In one particular example, which should not be construed as limiting in the present invention, cot roll 14 can have a diameter in the range of 14 inches to 17 inches, and cutter roll 16 diameter in the range of 4 to 6 inches, with 100 to 140 blades equally spaced about the circumference of the cutter roll, depending on the roll diameter and chopped strand length. When rolls 14 and 16 are positioned to sever strands 20, in this particular nonlimiting example, the blades or elongated structures 72 of cutter roll 16 can penetrate, i.e. extend into corresponding slots 64 to a depth in the range of 0.025 inches to 0.065 inches (0.635 mm to 1,651 mm). More particularly, as the strands 16 are initially chopped, the blades of cutter roll 16 extend 0.025 inches into the corresponding slots 64 of cot roll 14. However, as the chopping continues and the edges and walls of the slots 64 become worn due to the chopping action, the depth the blades penetrate the slots 64 is increased to ensure that the strands 20 are cut to the desired length. Further, in this particular nonlimiting example, slots 64 can have an initial width in the range of 0.015 inches to 0.045 inches (0.381 mm to 1.143 mm). In one particular nonlimiting example, the ratio of the cot roll diameter to cutter roll diameter, or gear ratio, is 3.11 to 1.

Referring to FIG. 2, each of the plurality of slots 64 and each of the plurality of elongated structures 72 can have a predefined, angular position 74 and 76 on each respective roll 14 and 16. The angular positions define the angle at which the elongated structures 72 enter and exit the slot 64 and will affect the wear of the slot walls and edges. Further, corresponding pairs of each of the plurality of slots 64 and each of the plurality of elongated structures 72 can be successively rotationally directed into a predefined, desired angular position 78 with respect to one another for severing strands 20 (FIG. 1). For example, the predefined, desired position 78 can correspond to a dead center position where the respective elongated structure is centered within the respective, corresponding slot. It should be noted, however, that the predefined, desired position 78 can be offset from such a center position. Further, rolls 14 and 16 can be positioned in the predefined, desired radial spacing 41 with respect to one another for severing strands 20. The predefined, desired radial spacing 41 is measured as a distance between the axes of rotation 60 and 70, and establishes the depth that a elongated structure 72 penetrates into a slot 64. Thus, the predefined, desired angular position 78 and the predefined, radial positioning 41 form a desired position of each of the plurality of slots 64 and each of the plurality of elongated structures 72, as well as cot roll 14 and cutter roll 16, with respect to one another for severing strands 20.

Drive system 38 includes one or more motors or other positioning mechanisms coupled to rolls 14 and 16 and capable of radially and rotationally positioning the rolls with respect to each other and independently driving the rolls according to the received drive commands 36. Suitable examples of drive system 38 include, but are not limited to electric motors, stepper motors, servo motors, synchronous motors, etc. A nonlimiting example of a suitable rotational drive motor of drive system 38 is a model number 44ACA61 servo motor from Yaskawa Electric America (Waukegan, Ill.), and of a suitable radially-positioning motor of the drive system is a model number 20ACA61 servo motor from Yaskawa Electric America (Waukegan, Ill.).

Sensor system 34 includes one or more devices to detect or measure at least one actual current roll property of each roll, i.e. the actual current rotational position and/or actual current radial position of the cot roll 14 and the cutter roll 16 and generate and transmit a current state signal, i.e. a current rotational position state signal and/or a current radial position state signal representative of such roll's position. These current position state signals can be included in feedback signals 32 to control system 12, as will be discussed later in more detail. Based on these current position state signals, the control system 12 can determine the actual current alignment of the rolls. More particularly, predetermined control parameters 40 analyze the previously-stored first and second roll reference signals and current state signals and calculate error signals representative of the difference between a desired state of the particular roll, i.e. the rotational properties at which the first or second roll should be operating, and the actual current state of such roll. The error signals are then analyzed by the predetermined control parameters 40, in combination with drive commands, to determine revised first and/or second roll drive commands. Thus, each roll is driven by system commands to achieve, for example, a desired velocity and/or angular position and predetermined control parameters modify the signal driving each roll based on feedback signals representative of an error between the desired and actual current position of the roll.

Sensor system 34 can include any type of device, such as but not limited to an electrical, mechanical, magnetic, acoustic, optical, etc. type device. One nonlimiting example of a suitable sensor system 34 is a 17 bit incremental encoder having 131,072 pulses per revolution (ppr), such as can be built into the above-mentioned model number 20ACA61 servo motor from Yaskawa Electric America (Waukegan, Ill.). If desired, sensor system 34 can include separate encoders having more or less pulses per revolution, up to and including 2 million pulses per revolution. While encoders with relatively high pulses per revolution can provide increased accuracy, there is a tradeoff in the bandwidth and time required for processing the data associated with such encoders.

Predetermined control parameters 40 are stored within control system 12 and include one or more predetermined sets of instructions for analyzing the incoming operational signals, such as system commands 28 and feedback commands 32, and generating drive commands 36 to operate fiber chopper 18. Drive commands 36 are signals that are received and interpreted by drive system 38 to control drive system to rotate and position rolls 14 and 16. Further, predetermined control parameters 40 can take into account the gear or diameter ratio between first roll 14 and second roll 16 in order to synchronize the rotation of the rolls. If desired, there can be an individual set of predetermined instructions associated with the roll properties of each individual roll, i.e. a first set of instructions associated with the rotational position of first roll 14 and a second, separate set of instructions associated with the rotational position of second roll 16, as well as instructions controlling the radial spacing 41 between the rolls.

Figure 3:
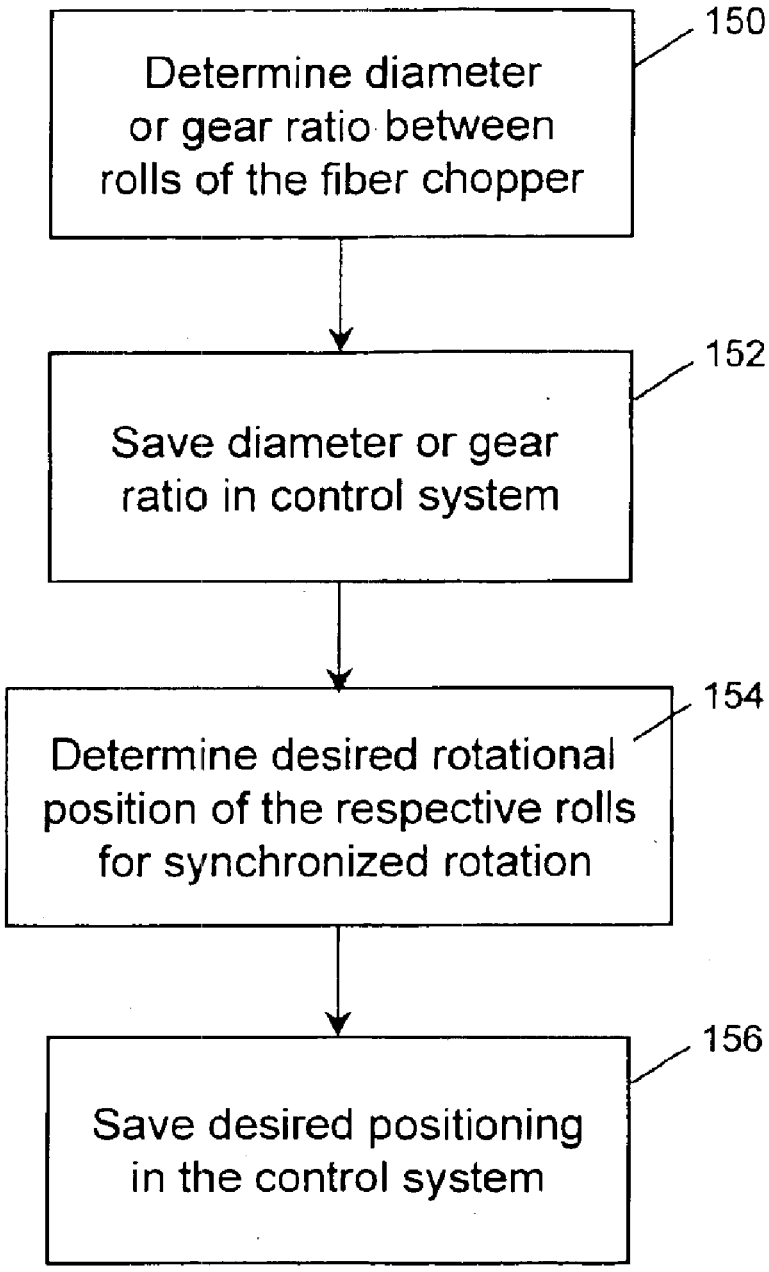
FIG. 3 is a flowchart of a method of performing an operational set-up for the system of FIG. 1.

Prior to operating fiber chopper 18, first roll 14 and second roll 16 are installed on the fiber chopper 18 and the machine is set-up for operation. Referring to FIG. 3, the fiber chopper set-up includes determining the diameter or gear ratio of the first roll with respect to second roll (Block 150). For example, an operator can engage and rotate the rolls for one complete revolution of the largest diameter roll. Based on the feedback signals from the sensor devices associated with each roll, for example the number of pulses from each encoder, the diameter or gear ratio can be determined very precisely. Once the diameter or gear ratio has been determined, it is then entered into the predetermined control parameters to be used as a factor in rotating the first and second rolls (Block 152). After entering the diameter or gear ratio into the control system, then the desired positioning of the first roll with respect to the second rolls is determined (Block 154). For instance, the first and second rolls can be rotated again and their respective states are measured to position the respective slots and elongated structures or blades in a position for synchronized rotation. For example, as the rolls are rotated, the torque of the motor associated with the roll that is used as a reference for driving the other roll is measured and the rotational position of the rolls are adjusted based on the measurements. For instance, an increase in torque generally relates to the surfaces of the elongated structures pushing against a side of the corresponding slots. The angular position of the rolls can be adjusted so that both sides of the slots are determined based on the torque, and then the desired angular position is set based on these measurements. For example, the desired angular position can be the position halfway between the two highest torques that defined each side wall of a slot. Once the desired positioning of the rolls is determined, this desired positioning is input into the control system and the fiber chopper is ready for operation (Block 156).

Figure 4:
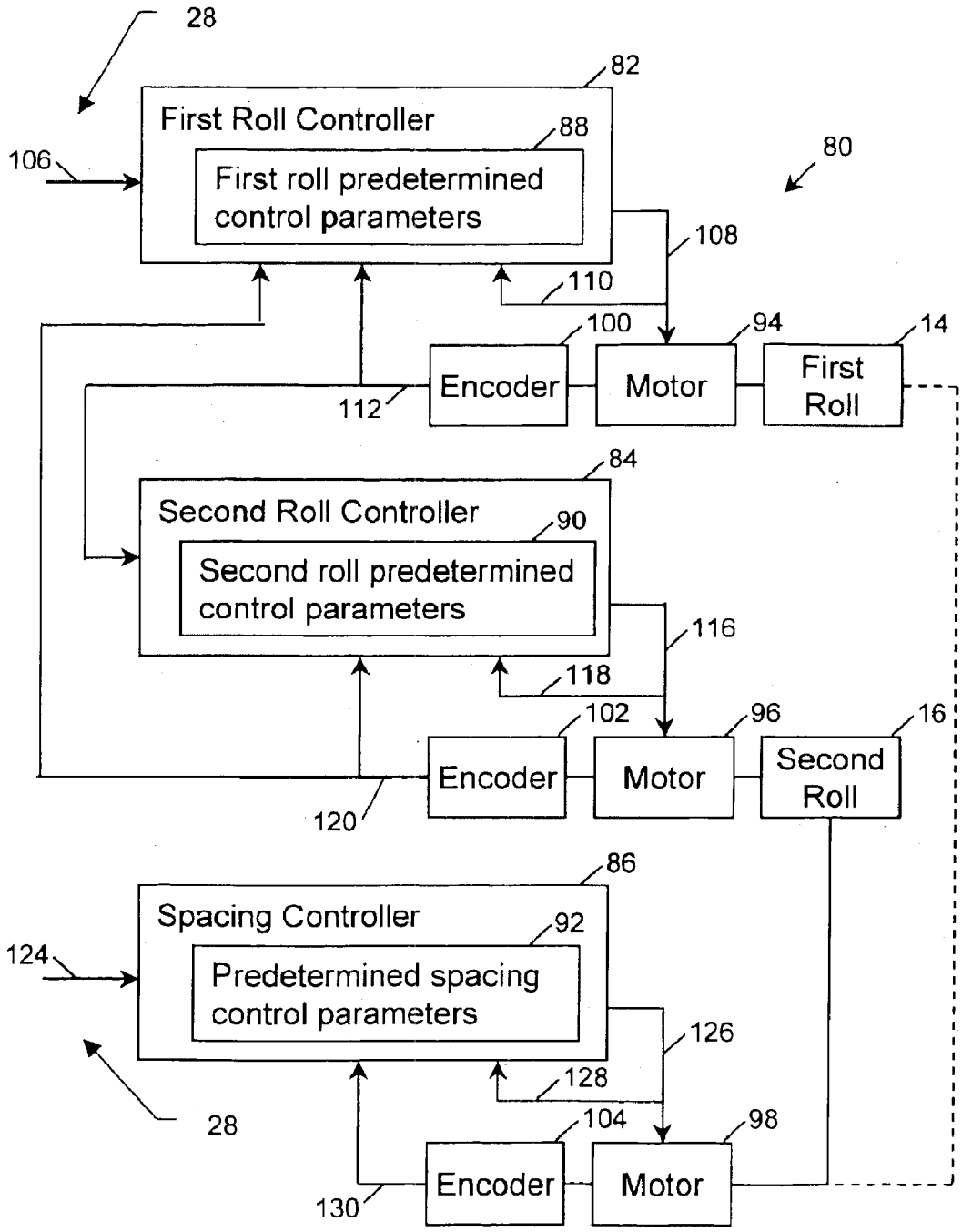
FIG. 4 is a schematic diagram of another nonlimiting embodiment of a system for severing elongated material incorporating features of the present invention, including separate controllers and predetermined control parameters associated with motors for rotating, angularly positioning and radially positioning the first and second rolls.

Referring to FIG. 4, one nonlimiting embodiment of a system 80 for severing elongated material includes control system 12 having separate roll controllers 82 and 84 for controlling the rotational properties of first roll 14 and second roll 16, respectively, e.g. the rotational velocity and the angular position of the rolls, as well as another roll controller 86 for controlling the radial positioning or spacing 41 of the rolls with respect to each other. Further, each roll controller 82, 84 and 86, respectively, includes its own set of predetermined control parameters 88, 90 and 92 to analyze the incoming system and feedback commands and generate drive commands. Additionally, drive system 38 includes separate first and second roll motors 94 and 96 for rotating and angularly positioning first and second rolls 14 and 16, respectively, as well as positioning motor 98 for radially positioning the rolls with respect to each other. Further, sensor system 34 includes separate first and second roll sensors 100 and 102 for detecting and monitoring the rotational properties of first and second rolls 14 and 16, respectively, as well as positioning sensor 104 for detecting and monitoring the radial spacing 41 between the rolls.

Figure 5:
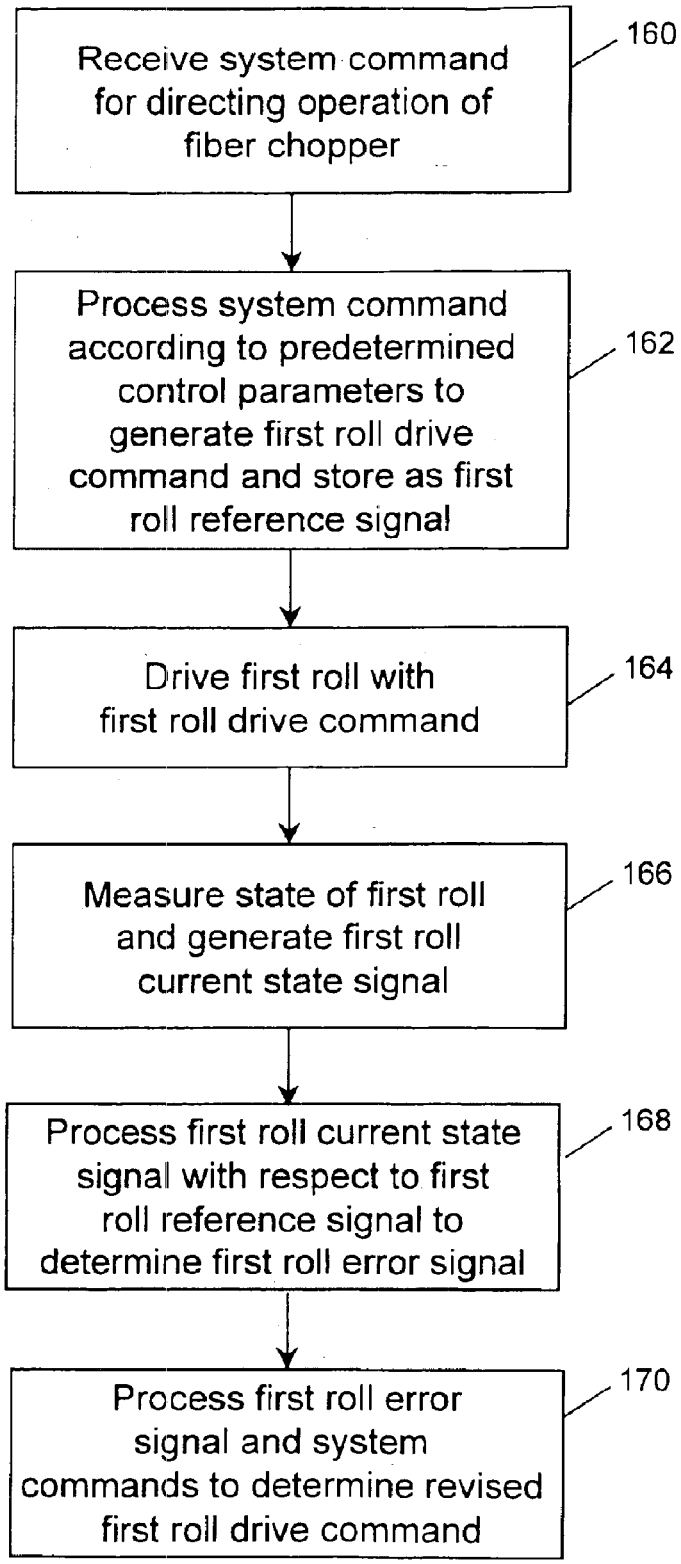
FIG. 5 is a flowchart of one nonlimiting embodiment of a method for rotating and angularly positioning the first roll of FIG. 4.

In operation and additionally referring to FIGS. 4 and 5, first roll controller 82 receives system command 28 for directing the operation of fiber chopper 18 (Block 160). For example, system command 28 can include operator inputted control signal 106 such as a linear velocity of strands passing through the fiber chopper 18, a start signal to initiate operation of the fiber chopper 18, a stop signal to halt operation of the fiber chopper 18, error or feedback signals as discussed below in more detail, or any other suitable operational signal. After suitable signal modifications, if any are required, control signal 106 is inputted into first roll predetermined control parameters 88. Signal modifications can include signal scaling, applying gain, multiplication, differentiation, smoothing, binary/analog conversion, filtering, etc. First roll predetermined control parameters 88 apply selected predetermined instructions to control signal 106, based on the command signal, the first roll feedback signals (discussed below), roll diameter ratios, roll and/or slots/elongated structure angular positions, etc., to generate a first roll drive command 108 that is sent to first roll motor 94 (Block 162). For example, first roll drive command 108 can include a signal that directs first roll to be rotated at a given rotational velocity to correspond to a linear velocity of the strands moving through fiber chopper 18. Additionally, first roll controller 82 stores a first roll reference signal 110 representative of control signal 106 and/or first roll drive command 108 (Block 162). Then, first roll motor 94 rotates first roll 14 based on first roll drive command 108 (Block 164). First sensor 100 detects the actual current roll properties of first roll 14 and generates a first roll current state signal 112 representative of the current rotational position of roll 14 (Block 166). First roll current state signal 112 is included as one of the feedback commands 32 (see FIG. 1) associated with system 80, as it is received by first predetermined parameters 88 of the first roll controller 82, and further is included as one of drive commands 28 (see FIG. 1) received by second roll controller 82. For example, as a feedback command, first roll current state signal 112 can represent the rotational velocity and/or rotational position of first roll 14. First predetermined control parameters 88 analyze the previously-stored first roll reference signal 110 and first roll current state signal 112 and generate a first roll error signal representative of any difference, or error, between a desired state of the first roll, i.e. the rotational properties at which the first roll should be operating, and the current rotational position of the first roll (Block 168). The first roll error signal is then analyzed by first predetermined control parameters 88, in combination with drive commands 106, to generate a revised first roll drive command 108 (Block 170). The revised first roll drive command can include, e.g. a change in the rotational velocity of the first roll required to reposition the first roll to a desired alignment position. Thus, first roll 14 is driven by system commands, and predetermined control parameters modify the signal driving the first roll based on feedback signals representative of the difference between the desired and actual state of the first roll.

Figure 6:
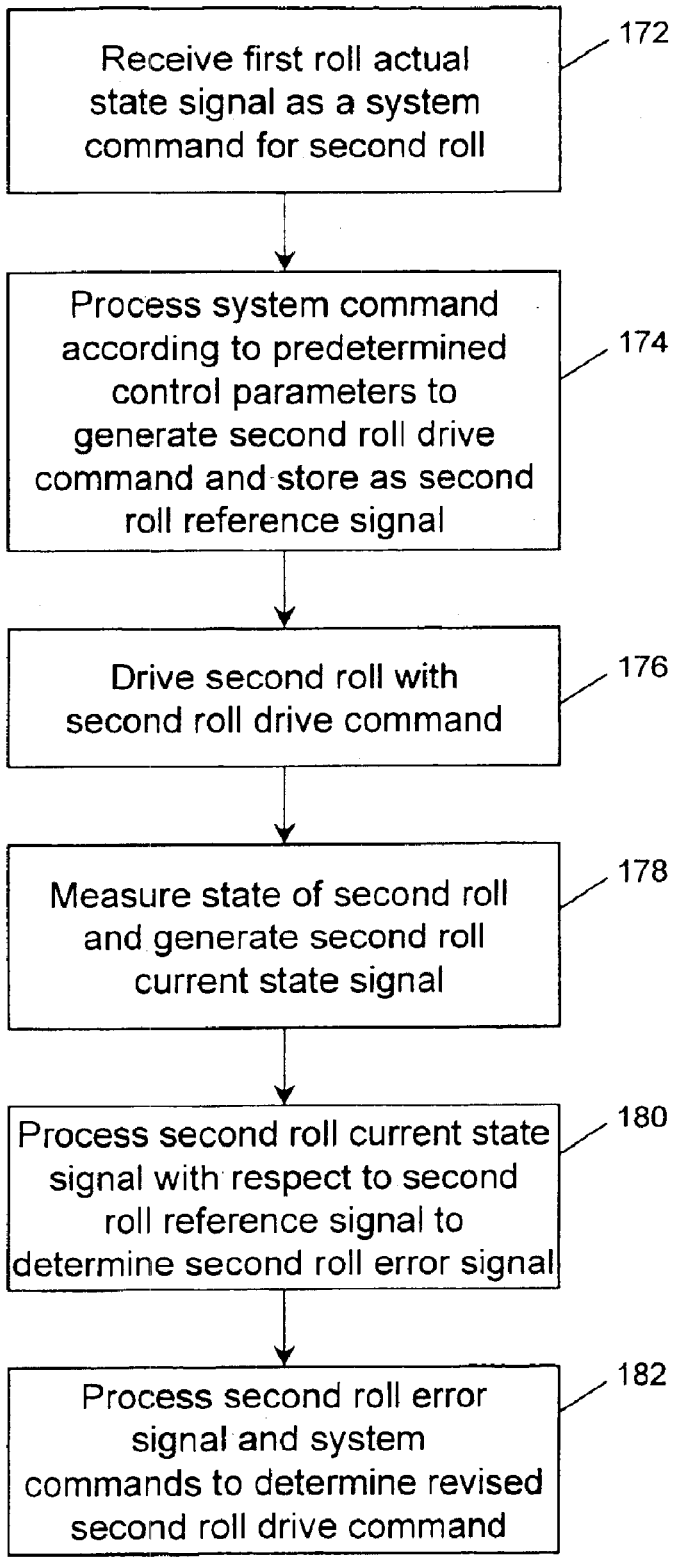
FIG. 6 is a flowchart of one nonlimiting embodiment of a method for rotating and angularly positioning the second roll of FIG. 4.

Referring to FIGS. 4 and 6, first roll actual state signal 112 comprises a drive command 28 that is inputted into second roll controller 84 (Block 172). Again, after appropriate signal modification, second roll predetermined control parameters 90 apply selected predetermined instructions to the inputted signal, based on the first roll actual state signal, the second roll feedback signals (discussed below), roll diameter ratios, roll and/or slots/elongated structure angular positions, etc., to generate a second roll drive command 116 that is sent to second roll motor 96 (Block 174). For example, second roll drive command 116 can include a signal that directs second roll 16 to be rotated at a given rotational velocity to correspond to the rotational velocity of first roll 14. Additionally, second roll controller 84 stores a second roll reference signal 118 representative of first roll actual state signal 112 and/or second roll drive command 116 (Block 174). Then, second roll motor 96 rotates second roll 16 based on second roll drive command 116 (Block 176). Second sensor 102 detects the actual current rotational properties of second roll 16 and generates second roll current state signal 120 representative of the current rotational position of roll 16 (Block 178). Second roll current state signal 120 is included as one of the feedback commands 32 associated with system 80, as it is received by second predetermined parameters 90. For example, as a feedback command, second roll current state signal 120 can represent the rotational velocity and/or rotational position of second roll 16. Second predetermined control parameters 90 analyze the previously-stored second roll reference signal 118 and second roll current state signal 120 and generate a second roll error signal representative of any difference, or error, between a desired state of the second roll, i.e. the rotational properties at which the second roll should be operating, and the current rotational position state of the second roll (Block 180). The second roll error signal is then analyzed by second predetermined control parameters 90, in combination with drive commands such as first roll current state signal 112, to determine second roll drive command 116 (Block 182). The revised second roll drive command can include, e.g. a change in the rotational velocity of the second roll required to reposition the second roll to a desired alignment position. Thus, second roll 16 is driven by signals representative of the actual current rotational position of first roll 14 and predetermined control parameters modify the signal driving the second roll based on feedback signals representative of the difference between the desired and current state of the second roll. In addition, second roll current state signal 120 can also be received by first roll controller 82 and be analyzed by first predetermined control parameters 88 to determine revised first roll drive commands 108.

Figure 7:
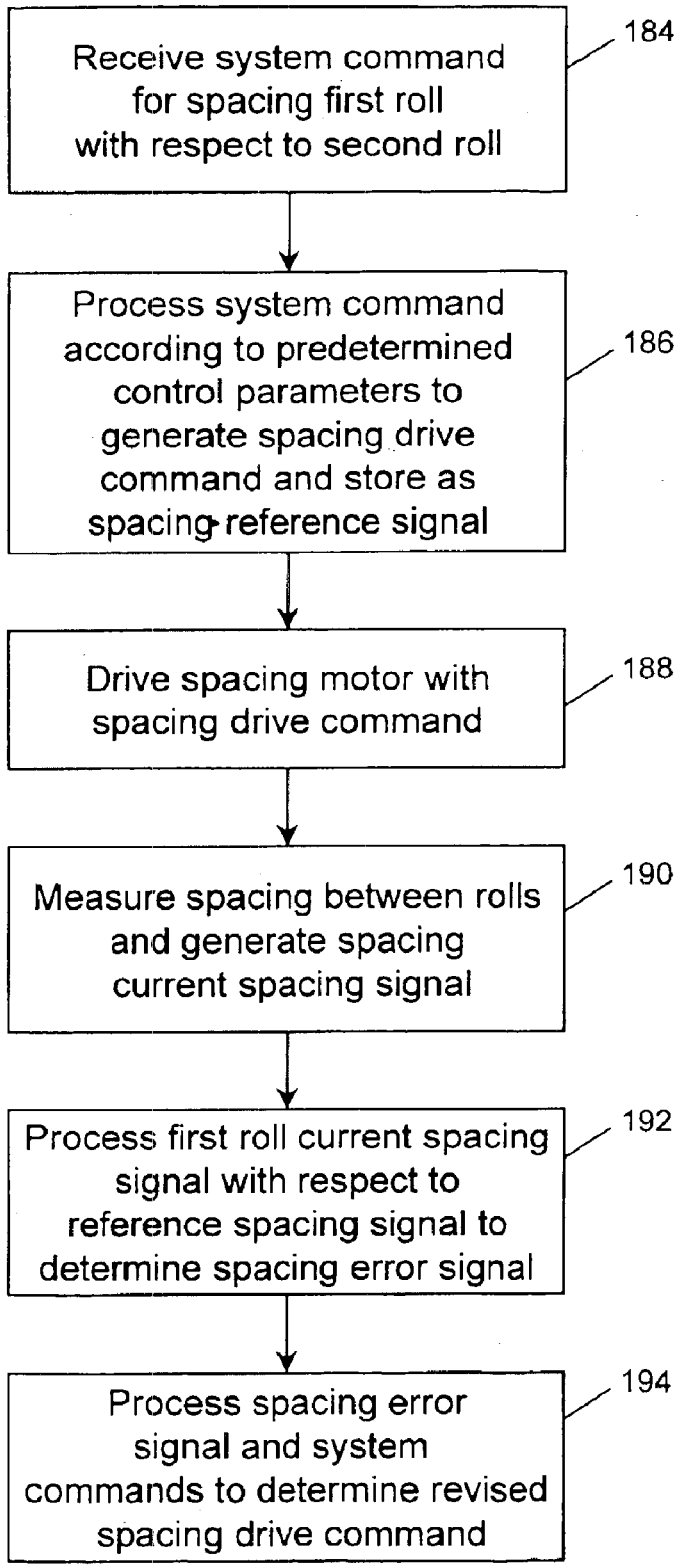
FIG. 7 is a flowchart of one nonlimiting embodiment of a method for radially positioning the first and second rolls of FIG. 4.

Similarly, referring to FIGS. 4 and 7, a system command 28 such as a spacing signal 124 inputted by an operator is received by spacing controller 86 (Block 184). For example, spacing signal 124 can represent a desired radial positioning or spacing 41 of first roll 14 with respect to second roll 16. Again, after appropriate signal modification, predetermined spacing control parameters 92 apply selected predetermined instructions to spacing signal 124, based on the spacing position command, the spacing position feedback signals (discussed below), roll diameter ratios, roll and/or slots/elongated structure angular positions, etc., to generate a spacing drive command 126 that is sent to positioning motor 98 (Block 186). For example, spacing drive command 126 can include a signal that directs first and second rolls 14 and 16 to have a given spacing 41 therebetween. Additionally, spacing controller 86 stores a spacing reference signal 128 representative of the desired spacing signal 124 and/or spacing drive command 126 (Block 186). Then, spacing motor 98 changes the relative spacing 41 between axes 60 and 70 based on the spacing drive command 126 (Block 188). Spacing sensor 104 detects the actual current relative positioning of rolls 14 and 16 and generates a current radial position signal 130 (i.e. spacing signal) representative of the current radial spacing between the rolls (Block 190). Current spacing signal 130 is included as one of the feedback commands 32 associated with system 80, as it is received by the predetermined control parameters 92. Predetermined spacing control parameters 92 analyze the previously-stored spacing reference signal 128 and current spacing signal 130 and generate a spacing error signal representative of any difference, or error, between the desired and the current radial position (Block 192). The spacing error signal is then analyzed by predetermined spacing control parameters 92, in combination with drive commands such as spacing signal 124, to determine spacing drive command 126 (Block 194). Thus, in combination with the rotational properties, i.e. the rotational and angular positioning described above, first roll 14 and second roll 16 can be radially positioned according to system commands to achieve, for example, a desired spacing corresponding to a depth of an elongated structure 72 within a slot 64. Further, predetermined control parameters modify the signal that radially positions the first and second rolls based on feedback signals representative of an error between the desired and current spacing between the first rolls.

Thus, among other features, the present invention provides a control and feedback system for synchronizing the rotational positioning and radial positioning of a first and second roll of a fiber chopper. Such a control and feedback system advantageously enables the fiber chopper rolls to be accurately positioned with respect to each other to eliminate wear and tear and thereby reduce maintenance costs.

Example embodiments of the present invention have now been described. It will be appreciated that these examples are merely illustrative of the invention. Many variations and modifications of the invention will be apparent to those skilled in the art.

We claim:

1. An apparatus for producing discontinuous lengths of filament, comprising:

a rotatable first roll having a first severing structure;

a rotatable second roll having a second severing structure, the second severing structure corresponding with the first severing structure for severing a length of the filament positioned between the rolls;

a drive system operable to independently rotate and radially position the first roll and the second roll according to a first roll drive command, a second roll drive command, and a roll spacing drive command;

a sensor system operable to receive positional inputs representative of an actual current rotational position of the first roll, an actual current rotational position of the second roll, and an actual current radial spacing between the first roll and the second roll, the sensor system further operative to generate a first roll current rotational position state signal, a second roll current rotational position state signal, and a current radial spacing state signal corresponding to the positional inputs; and a control system operable to receive the first roll current rotational position state signal, the second roll current rotational position state signal, and the current radial spacing state signal and generate the first roll drive command, the second roll drive command, and the spacing drive command, wherein the control system synchronizes the positioning of the first severing structure and second severing structure during rotation of the first roll and the second roll.

2. The apparatus of claim 1, wherein the first severing structure comprises a plurality of slots spaced apart about a perimeter of the first roll, and the second severing structure comprises a plurality of elongated structures extending from and spaced apart about a perimeter of the second roll.

3. The apparatus of claim 2, wherein the plurality of slots extend longitudinally along the perimeter of the first roll and the plurality of elongated structures include a plurality of cutting blades extending longitudinally along the perimeter of the second roll.

4. The apparatus of claim 3, wherein the plurality of blades are spaced about the perimeter of the second roll at a spacing of at least five blades per inch.

5. An apparatus for producing discontinuous lengths of filament, comprising:

a rotatable first roll having a first severing structure;

a rotatable second roll having a second severing structure, the second severing structure corresponding with the first severing structure for severing a length of the filament positioned between the rolls;

a drive system operable to independently rotate the first roll and the second roll and to position the first roll and the second roll at a desired radial spacing with respect to each other according to a drive command;

a sensor system operable to make measurements and generate current state signals representative of at least one actual current roll property of the first roll, at least one actual current roll property of the second roll, and an actual current radial spacing between the first roll and the second roll; and a control system for receiving the current state signals that is operable to generate the drive command in accordance with predetermined control parameters and based on the at least one actual current roll property of the first roll, the at least one actual current roll property of the second roll, and the actual current radial spacing, wherein the drive command synchronizes the at least one actual current roll properties of the first roll and the second roll and wherein the drive command radially positions the first roll and the second roll.

6. The apparatus of claim 5, wherein the first severing structure comprises a plurality of slots spaced apart about a perimeter of the first roll, and the second severing structure comprises a plurality of elongated structures extending from and spaced apart about a perimeter of the second roll.

7. The apparatus of claim 6, wherein the plurality of slots extend longitudinally along the perimeter of the first roll and the plurality of elongated structures include a plurality of cutting blades extending longitudinally along the perimeter of the second roll.

8. The apparatus of claim 7, wherein the plurality of blades are spaced about the perimeter of the second roll at a spacing of at least five blades per inch.

9. The apparatus of claim 5, wherein the at least one actual current roll property of the first roll comprises the rotational position of the first roll and wherein the at least one actual current roll property of the second roll comprises the rotational position of the second roll.

10. The apparatus of claim 5, wherein the control system is operable to determine roll error signals corresponding to a difference between the actual current roll properties of the first roll and second roll and a desired roll property of the first roll and second roll, respectively, and wherein the control parameters utilize the roll error signals and the current state signals to calculate and determine the drive command.

11. The apparatus of claim 5, wherein the control system is operable to generate the drive command based on a radial spacing error signal corresponding to a difference between the current radial spacing and a desired radial spacing.

12. The apparatus of claim 5, wherein the drive command comprises a first roll drive command and a second roll drive command, wherein the first roll drive command is based on the at least one actual current roll property of the first roll and the second roll drive command is based on the at least one actual current roll property of the second roll.

13. The apparatus of claim 5, wherein the drive command comprises a first roll drive command and a second roll drive command and both the first roll drive command and the second roll drive command are based on the at least one actual current roll property of the first roll.

14. The apparatus of claim 5, wherein the drive command comprises a first roll drive command and a second roll drive command, wherein the first roll drive command is based on the at least one actual current roll property of the first roll, at least one desired roll property of the first roll corresponding to the at least one actual current roll property of the first roll, and a system drive command based on a velocity of the filament between the first roll and the second roll, and wherein the second roll drive command is based on the at least one actual current roll property of the first roll, the at least one actual current roll property of the second roll, and at least one desired roll property of the second roll corresponding to the at least one actual current roll property of the second roll.

15. The apparatus of claim 14, wherein the at least one desired roll property of the first roll and the at least one desired roll property of the second roll correspond to the synchronized positioning of the first severing structure of the first roll and the second severing structure of the second roll.

16. The apparatus of claim 5, wherein the control system is operable to generate the drive command based on a radial spacing error signal corresponding to a difference between the current radial spacing and a desired radial spacing.

* * * * *